US005127153A

United States Patent [19]

Mitra

[11] Patent Number: 5,127,153

[45] Date of Patent: Jul. 7, 1992

[54] INSULATION-PIERCING CONNECTOR WITH CLAMPING LIP, AND TOOL FOR BENDING THEREOF

[75] Inventor: Niranjan Mitra, Eindhoven, Netherlands

[73] Assignee: E. I. Du Pont de Nemours & Company, Wilmington, Del.

[21] Appl. No.: 719,088

[22] Filed: Jun. 19, 1991

[30] Foreign Application Priority Data

Jun. 20, 1990 [NL] Netherlands ..... 9001406

[51] Int. Cl.[5] ..... H01R 43/04

[52] U.S. Cl. ..... 29/753; 29/758; 439/395

[58] Field of Search ..... 439/389–425; 29/751, 753, 758

[56] References Cited

U.S. PATENT DOCUMENTS

| | | | |
|---|---|---|---|
| 3,145,261 | 8/1964 | Forney, Jr. | 174/84 |
| 3,805,214 | 4/1974 | Demler, Sr. et al. | 439/399 |
| 3,842,392 | 10/1974 | Aldridge et al. | 339/47 |
| 4,029,384 | 6/1977 | Reinwald, Jr. | 439/397 |
| 4,174,877 | 11/1979 | Foederer | 339/97 |
| 4,209,218 | 6/1980 | Kosten et al. | 439/395 |
| 4,277,124 | 7/1981 | Loose et al. | 339/99 |
| 4,740,171 | 4/1988 | Holden et al. | 439/396 |
| 4,749,368 | 6/1988 | Mouissie | 439/421 |

FOREIGN PATENT DOCUMENTS

| | | |
|---|---|---|
| 0321285 | 9/1989 | European Pat. Off. . |
| 8437785 | 11/1985 | Fed. Rep. of Germany . |
| 8528897 | 10/1986 | Fed. Rep. of Germany . |
| 7900331 | 5/1979 | PCT Int'l Appl. . |
| 1558582 | 3/1976 | United Kingdom . |

*Primary Examiner*—Joseph H. McGlynn

[57] ABSTRACT

Insulation piercing-connector having two parallel spaced cutting tongues each having a tapering introduction hole. A conductor surrounded by insulation is introduced without stripping. After introduction the conductor is clamped to the connector by at least one clamping lip. The clamping lip is provided in the space between the two cutting tongues.

1 Claim, 3 Drawing Sheets 5
4
3
8
2
1

INSULATION-PIERCING CONNECTOR WITH CLAMPING LIP, AND TOOL FOR BENDING THEREOF

BACKGROUND OF THE INVENTION

This invention relates to an insulation-piercing connector. In this kind of connectors it is not necessary to strip the wire before attachment to the connector. By piercing the insulation electric contact will be provided between the connector and the conductor

DESCRIPTION OF THE PRIOR ART

An insulation-piercing connector having an insulation-piercing connector, comprising at least two essentially parallel, spaced cutting tongues, each provided with a tapering insertion hole for a conductor and at least one clamping lip for holding the conductor in place, is known from U.S. Pat. No. 4,277,124 and from U.S. Pat. No. 3,145,261. In the first-mentioned publication various clamping lips placed one after the other are present, int urn lying at a distance from the front (or rear) cutting tongues. In the case of the design shown in this U.S. patent specification, the cutting tongues are formed by connecting bridges arranged at the top, i.e. at the point which first comes into contact with the conductor.

In the design according to U.S. Pat. No. 3,145,261 the cutting tongues are formed by a U-shaped material part in which the legs of the U comprise the two spaced cutting tongues. These legs contain not only the cutting tongues, but also extensions. These extensions are folded over the cutting tongues, so that the conductor is confined therein at the position of the cutting tongues. Both the device according to U.S. Pat. No. 4,277,124 and the device according to U.S. Pat. No. 3,145,261 have the disadvantage that the sheet from which the insulation-piercing connector is stamped must be larger, on account of the presence of the clamping lips. Another disadvantage is that the insulation-piercing connector is increased in size through the presence of the clamping lips. The latter disadvantage is particularly important in applications in which a large number of insulation-piercing connectors is being used on a very small surface. Such miniaturization is being increasingly sought in technology. An attempt was made to avoid these problems by using a central pull relief, but it was not satisfactory from the point of view of fitting and removal.

U.S. Pat. No. 4,749,368 discloses an insulation-piercing connector comprising a flat sheet in which pointed projections are formed by pressing. Lips are fitted on the sides of the pointed projections. Through fitting the conductor on the sheet and then clamping the lips, the insulation of the conductor will be pierced and will make contact in the pointed projections.

SUMMARY OF THE INVENTION

The object of the present invention is to avoid the above-mentioned disadvantages and to provide an insulation-piercing connector which can be achieved in a material-saving and thus cheap manner, and which is space-saving.

This object is achieved with an insulation-piercing connector having an insulation-piercing connector, comprising at least two essentially parallel, spaced cutting tongues, each provided with a tapering insertion hole for a conductor, and at least one clamping lip for holding the conductor in place, wherein the working position the clamping lip engages between the cutting tongues. Fitting the clamping lip(s) between, instead of behind or above, the cutting tongues produces a saving of space. For the space between the cutting tongues was hitherto not used for any purpose at all. The clamping lip does not project beside or above the cutting tongue, so that a particularly space-saving structure is obtained. Placing the clamping lip between the cutting tongues means that little material is needed.

According to an advantageous embodiment of the invention, two opposite-lying clamping lips are; present. They can be either two "half" clamping lips or two adjacent lips containing the entire conductor, so that a double guarantee of clamping is provided. In this latter embodiment the clamping lips are preferably bevelled complementary to each other when fitted.

According to a further preferred embodiment, the insulation-piercing connector is a material part. Depending on the number of clamping lips, the insulation-piercing connector can be formed in various ways. If one clamping lip is present, the insulation-piercing connector preferably has a U-shaped part, in which the legs of the U comprise the cutting tongues and the base is the clamping lip. If two opposite-lying clamping lips are present, the insulation-piercing connector preferably comprises a square part, in which two opposite sides comprise the cutting tongues, and the other opposite sides the clamping lips.

The invention also relates to a tool for positioning, by bending over, the clamping lip(s) of an above-described insulation-piercing connector. This is provided according to the invention with a channel accommodating the conductor and provided with two spaced recesses for the accommodation of cutting tongues between them and a curvature provided between them and accommodating the clamping tongue.

DETAILED DESCRIPTION OF THE EMBODIMENTS

Figure 1:
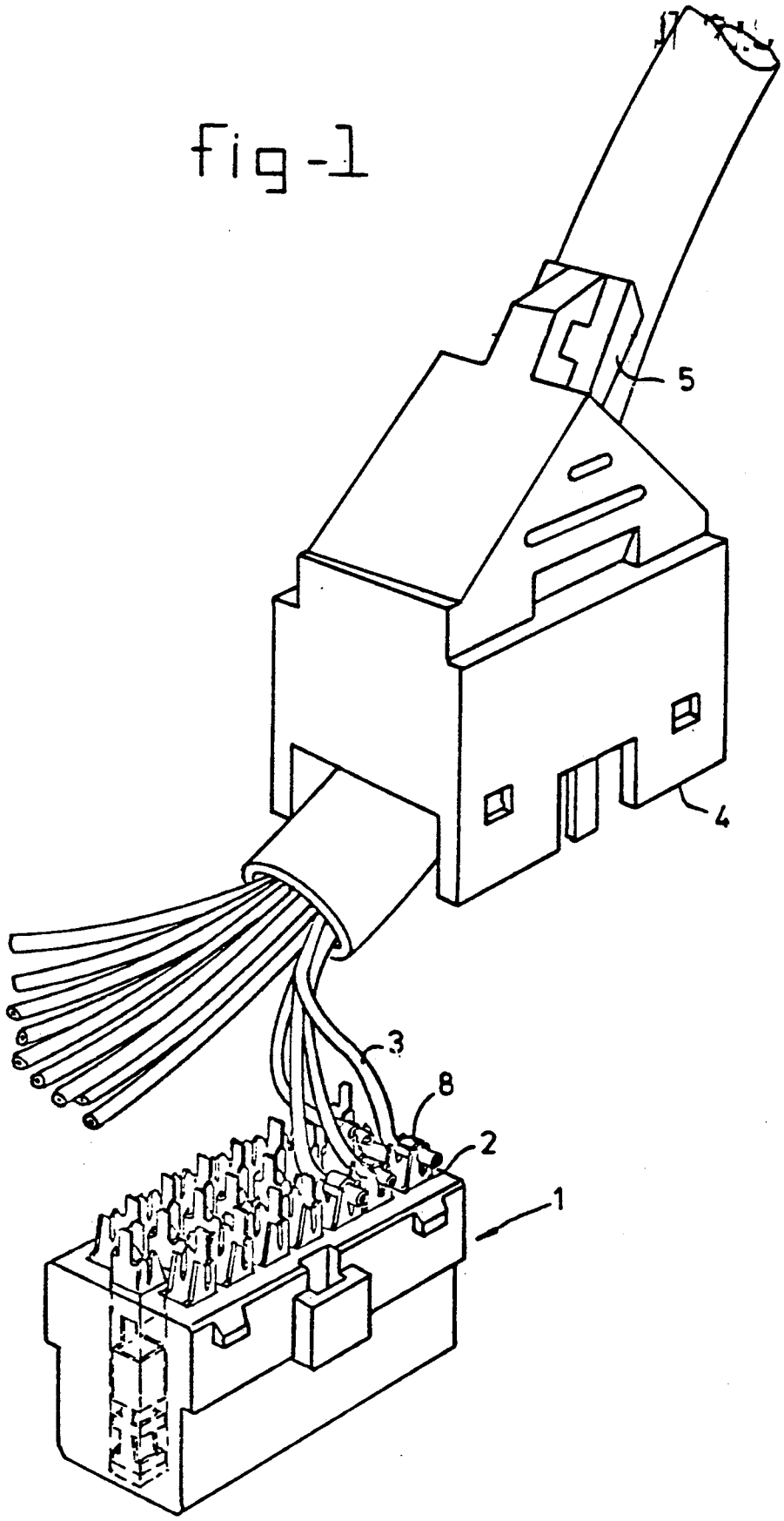
FIG. 1 shows in exploded view in perspective a plug block comprising various insulation-piercing connectors according to the invention.
Figure 2:
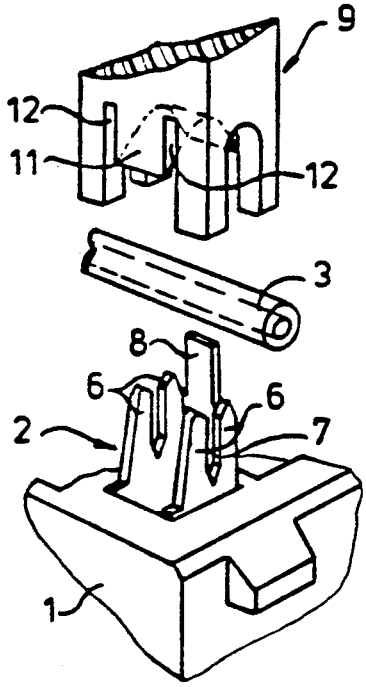
FIG. 2 shows a detail of the plug block shown in FIG. 1, showing schematically a conductor with tool at the moment of fitting.

FIG. 1 shows a plug block, generally referred to 1. It comprises a number of insulation-piercing connectors 2, in which conductors 3 must be fitted. After fixing of the conductors 3, cap 4 of the plug block is snapped on. A further pull relief could be fitted on projection 5, if desired. As can be seen from FIG. 2, each insulation-piercing connector is composed of two spaced cutting tongues 6, within which cutting edges 7 are provided through a tapering opening. A clamping lip 8 is present between the cutting tongues. FIG. 2 also shows a tool, generally referred to by 9, provided with a curve 11. Recesses 12 are also present. Starting from the position in FIG. 2, clamping of conductor 3 can be achieved in the following manner. When the tool 9 is moved downwardly, recesses 12 will accommodate cutting tongues 6. Conductor 3 is pressed between cutting edges 7, in which case the insulation is pierced and electrical contact is made in the usual manner. Curvature 11 on downward movement bends lip 8, and in the end the position shown in FIG. 1, in which lip 8 is shown curved at the bottom right in plug block 1, is realized. In this way pull relief of the conductor is achieved in a particularly space-saving and material-saving manner. Although tool 9 is shown as a single part for a single conductor 3, it will be understood that tool 9 can be designed in such a way that more than one insulation-piercing connector at a time is provided with the appropriate conductor. It is possible in this way to work with particular efficiency.

Figure 3:
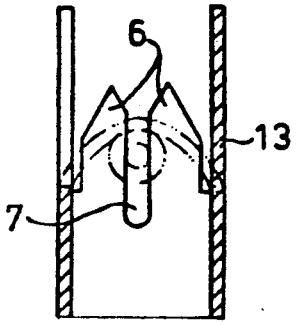
FIG. 3 shows a further embodiment of the insulation-piercing connector according to the invention.

FIG. 3 shows a further embodiment of the invention. Instead of a single clamping lip, as in FIG. 2, use is made hereof two opposite clamping lips 13, each of which is bevelled in such a way that when the conductor is fitted (not shown) they fill the space between the two cutting tongues in a complementary fashion.

Figure 4:
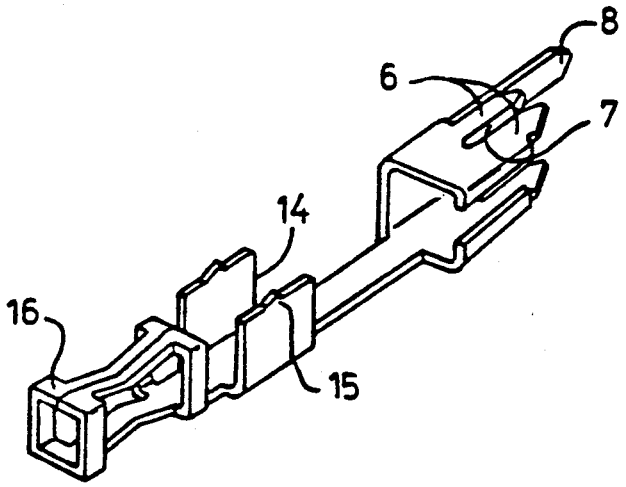
FIG. 4 shows a perspective view of the embodiment according to FIGS. 1 and 2, removed from the plug block intended for it.

FIG. 4 shows a complete insulation-piercing connector in the position not fitted in the plug block, in the embodiment with one lip. It can be seen that it is formed from a U-shaped part, the base of the U forming the clamping lip 8, while the legs form the cutting tongues 6. The whole unit is connected to the next U-shaped part, which is indicated by 14. The latter is provided with protrusions 15 which snap behind corresponding holes present in the plug block (not shown). In its extension contact lips 16 are fitted for the accommodation of a pin which has to be fitted in the plug block.

Although the invention is disclosed above on the basis of a preferred embodiment, it must be understood that numerous modifications can be made thereto, without departing from the scope of the present application. It is, for example, possible in an embodiment with opposite lips for these lips to extend over the full width of the distance between the two cutting tongues, and for them to be folded over one another, or each made a half length. It is also possible to fit double cutting tongues, i.e. if two conductors have to be fitted on one insulation-piercing connector, the insulation-piercing connector can be made of a square part, while in two opposite sides provision is always made for two insertion holes for the accommodation of one conductor each, and the other opposite sides provide the clamping lips. An embodiment of a double insulation-piercing connector is known, for example, from the earlier-mentioned U.S. Pat. No. 3,145,261.

I claim:

1. A device for terminating an insulated conductor of a cable to an insulation piercing connector wherein said connector comprises at least one pair of substantially parallel cutting tongues spaced apart from one another, each tongue having a tapered, central slot defined by a pair of tapered cutting edges for receiving and piercing the insulated conductor, said connector further having at least one clamping lip disposed at one side between said pair of cutting tongues and adapted to be bent over and to clamp the conductor after it is received in the slot of each tongue, said device comprising at one surface thereof at least one pair of substantially parallel channels spaced apart the same distance as said tongues, a recess extending in a direction transversely to said parallel channels, and a concave surface disposed between said parallel channels, wherein when said tool is moved downward onto said connector, the parallel channels will receive the parallel tongues after said tongues pierce the insulated conductor at two locations and the conductor will be accomodated in said recess while the concave surface will bend the clamping lip over the conductor between said two locations to clamp the conductor securely to the connector.

* * * * *